US006084976A

United States Patent [19]

Lin

[11] Patent Number: 6,084,976

[45] Date of Patent: Jul. 4, 2000

[54] EARPHONE WITHOUT IMPULSE NOISE AND CONDUCTIVE HEARING LOSS

[76] Inventor: Chung-Yu Lin, 29, Tunnel 152, Kuang Hwa 1 Rd., Kaohsiung, Taiwan

[21] Appl. No.: 09/330,372

[22] Filed: Jun. 11, 1999

[51] Int. Cl.[7] ..... H04R 25/00

[52] U.S. Cl. ..... 381/380; 381/370; 381/371; 379/430; 181/129

[58] Field of Search ..... 381/370, 371, 381/372, 373, 374, 380, 347, 348, 72, 74; 379/430; 181/129, 135, 137

[56] References Cited

U.S. PATENT DOCUMENTS 4,005,278 1/1977 Gorike ..... 381/370

FOREIGN PATENT DOCUMENTS 002451427 5/1975 Germany ..... 381/FOR 149
353041219 4/1978 Japan ..... 381/FOR 149

*Primary Examiner*—Curtis A. Kuntz
*Assistant Examiner*—Dionne N. Harvey
*Attorney, Agent, or Firm*—Raymond Y. Chan; David and Raymond

[57] ABSTRACT

An earphone without impulse noise and conductive hearing includes a loudspeaker having a first sound output end for producing a high intensive sound wave and a second sound output end for producing a low intensive sound wave, and an earphone housing which includes a housing body, a sound output hood and a sound collecting hood. The housing body has a first open-end, a second open-end and a receiving chamber therein for mounting the loudspeaker. A sound output hood, which has a plurality of meshes thereon, is positioned in front of the first sound output end of the loudspeaker. The sound collecting hood, which has a plurality of meshes thereon, is positioned in front of the second sound output end of the loudspeaker. In which, the high intensive sound wave produced at the first sound output end emits outside the housing body through the meshes of the sound output hood and returns between the second sound output end of the loudspeaker and the sound collecting hood inside the housing body through a sound inlet provided around the housing body. Thereby the high intensive sound wave and the low intensive sound wave are constructively and destructively interfered between the sound collecting hood and the second sound output end of the loudspeaker to form a combined sound wave with high-clarity sound interval to emit through the meshes of the sound collecting hood.

8 Claims, 8 Drawing Sheets

EARPHONE WITHOUT IMPULSE NOISE AND CONDUCTIVE HEARING LOSS

BACKGROUND OF THE PRESENT INVENTION

1. Field of Invention

The present invention relates to an earphone without impulse noise and conductive hearing loss, wherein the sound waves from the loudspeaker thereof would not directly transmit to the middle ear so as to prevent conductive hearing loss caused by the direct impact of the sound pressure.

2. Description of Related Arts

In 1990, the National Institutes of Health Consensus Development Conference State announced: "there are about 28 million American have hearing loss problem, among those people, at least one million people have hearing loss from high impact noise environment." Additionally, in 1993, National Ear Care Plan claimed that approximate 1.7% of American Teen, under 18, have hearing disability. Furthermore, in 1997, UT Southwestern Medical Center stated: "approximate 20% of American Teen, between 13–19, have hearing disability. The major cause of the hearing loss is people exposed to the noise especially the impulse noise from the earphone." People should concern the control of the sound volume while using the traditional earphone (continuous hearing not more than one hour or six hours per day when sound pressure at 105 dB or 95 dB respectively). In fact, this flash impulse noise contains high sound pressure and may damage the eardrum or middle ear hearing loss. It is called Conductive Hearing Loss. America's medical report recently stated that the percentage of people having the Conductive Hearing Loss is gradually increasing since earphones are improperly used to listen hot music such as Rock and Roll.

Moreover, earphone receives signal from source such as walkman o communicator devices, and transfers the sound wave to human ear which the perceptible frequency range of human being is about 20 Hz to 20 kHz. In fact, the reproductive resonance of sound interval in above frequency range is not ideal since the source of sound is not come from millions dollars of high-end musical devices but from the walkman or communicator devices. Among these signal from walkman or communicator devices exist lots of feedback or noise, so the noise of 'beep' sounds often found at high frequency range and 'woo' sounds often found at low frequency range.

SUMMARY OF THE PRESENT INVENTION

The main object of the present invention is to provide an earphone without impulse noise and conductive hearing loss, which may reduce the sound pressure directly transmitted to the middle ear; even the intensive impulse noise output from the earphone, wherein the sound pressure to the middle ear will diminish as much as possible. Accordingly, the present invention can enhance people's listening enjoyment and avoid the Conductive Hearing Loss from the impact of the sound pressure.

Another object of the present invention is to provide an earphone without impulse noise and conductive hearing loss, wherein not only the sound emitted from the earphone but also the sound outside can be caught by the ear so that people will not be completely blocked hearing from outside which can put his/her life in danger.

Another object of the present invention is to provide an earphone without impulse noise and conductive hearing loss, wherein two different sound waves are generated by the loudspeaker in the earphone, which overlap with each other to intensify the reproductive resonance at the middle range of frequency of sound interval. Moreover, the present invention can filter and minimize the noise or feedback at higher and lower frequency range.

Another object of the present invention is to provide an earphone without impulse noise and conductive hearing loss, wherein the sound output from the earphone obtains the functions of resonance intensity and noise-attenuating which can purify and clarify the sound.

Another object of the present invention is to provide an earphone without impulse noise and conductive hearing loss, wherein the displacement, between the meshes of outlet and the loudspeaker, is designed to control the amplitude of overlapped sound wave to create a frequency proprietary sound effect and gives a better sound interval output from earphone or other communicator devices.

In order to accomplish the above objects, the present invention provides an earphone without impulse noise and conductive hearing, which comprises:

- a loudspeaker having a first sound output end which generates a high intensive sound, and a second sound output end which generates a low intensive sound;
- an earphone housing for mounting the loudspeaker therein;
- a sound output hood having a plurality of meshes, which is mounted in front of the first sound output end of the loudspeaker; and
- a sound collecting hood having a plurality of meshes, which is mounted in front of the second sound output end of the loudspeaker; wherein the sound collecting hood of the earphone housing is constructed as an earplug adapted for hanging between the tragus and the antitragus while listening music.

Whereby, the loudspeaker produces two different phases of sound wave; constructive and destructive interference occurs between the sound collecting hood and the second sound output end of the loudspeaker. A combination of high-clarity sound intervals is produced and transmitted from the meshes to human eardrum. Therefore, the continuous use of the earphone will not cause hearing loss or damages to people.

DETAILED DESCRIPTION OF THE PREFERRED EMBODIMENT

Referring to FIGS. 1 to 4, an earphone without impulse noise and conductive hearing loss is illustrated in accordance with the present invention. The earphone comprises a loudspeaker 10 and an earphone housing 20 adapted for vertically mounting the loudspeaker 10 therein. The loudspeaker 10 has a first sound output end 11 which produces a high intensive sound, and a second sound output end 12 which produces a low intensive sound.

Figure 5:
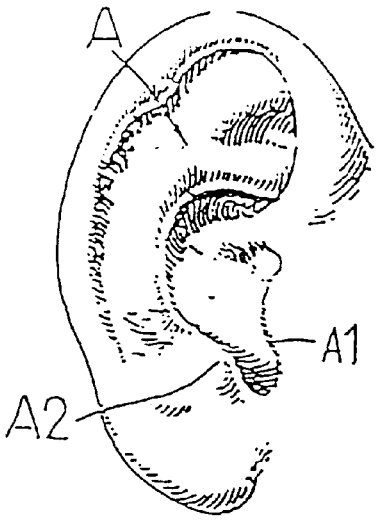
FIG. 5 is a perspective view of a human external ear.
Figure 6:
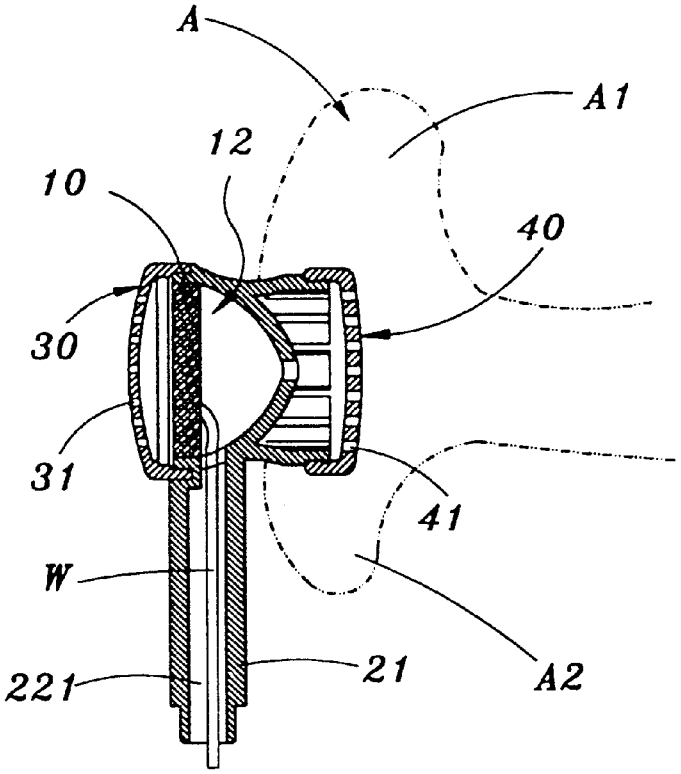
FIG. 6 is a sectional side view of the earphone hanged on the human external ear according to the above preferred embodiment of the present invention.

The earphone housing 20 further comprises a sound output hood 30 having a plurality of meshes 31, which is mounted in front of the first sound output end 11 of the loudspeaker 10, and a sound collecting hood 40 having a plurality of meshes 41, which is mounted in front of the second sound output end 12 of the loudspeaker 10. In which, the sound collecting hood 40 of the earphone housing 20 is constructed as an earplug adapted for hanging between a tragus A1 and an antitragus A2 while listening music, as shown in FIGS. 5 and 6. The loudspeaker 10 produces two kinds of sound wave with different displacements, which will be constructively overlapped and destructively interfered between the sound collecting hood 40 and the second sound output end 12 of the loudspeaker 10 to produce a combination of high-clarity sound intervals to transmit to the human eardrum through the meshes 41, so that the continuous use of the earphone will not cause hearing loss or damages to people.

Figure 1:
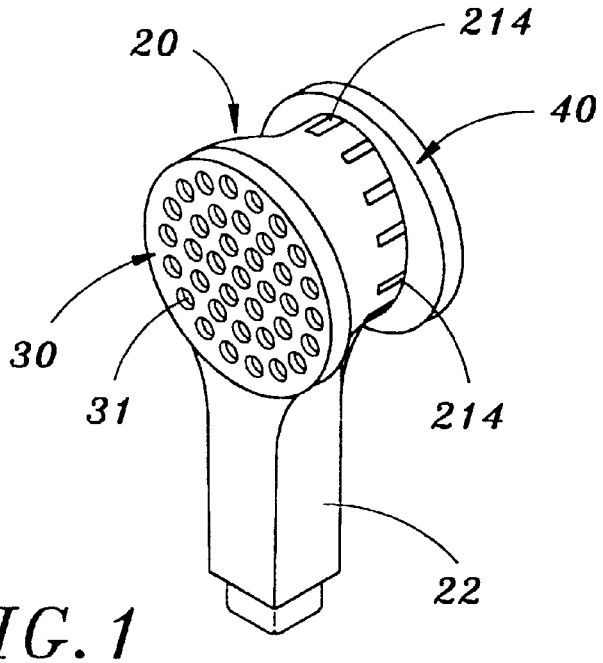
FIG. 1 is a perspective view of an earphone without impulse noise and conductive heating loss according to a preferred embodiment of the present invention.
Figure 2:
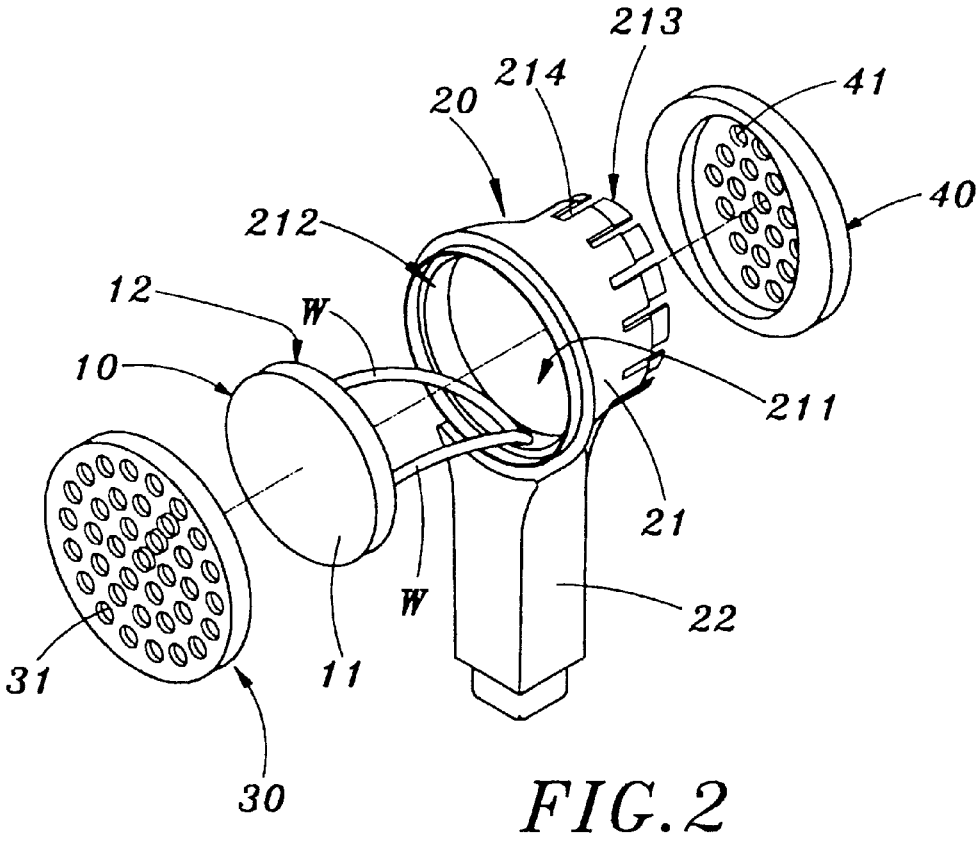
FIG. 2 is an exploded perspective view of the earphone according to the above preferred embodiment of the present invention.
Figure 3:
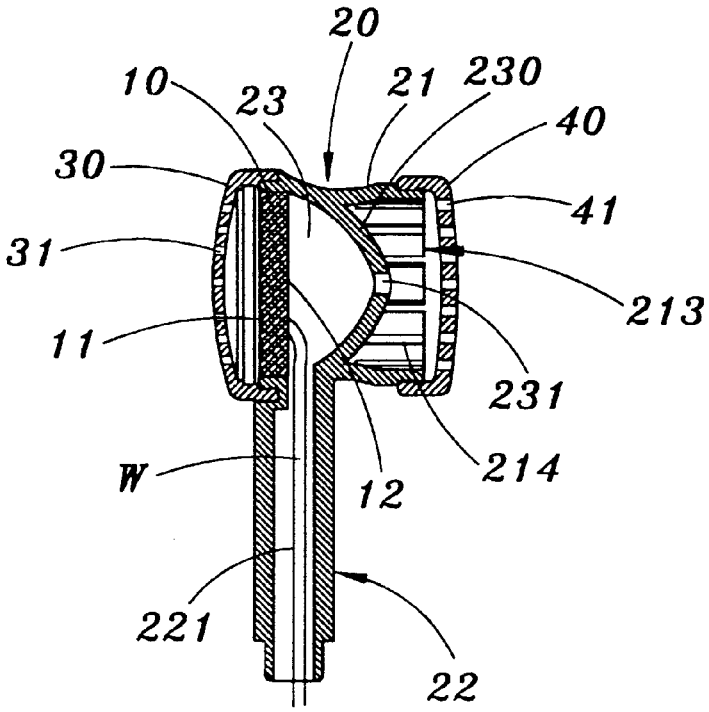
FIG. 3 is a sectional side view of the earphone according to the above preferred embodiment of the present invention.
Figure 4:
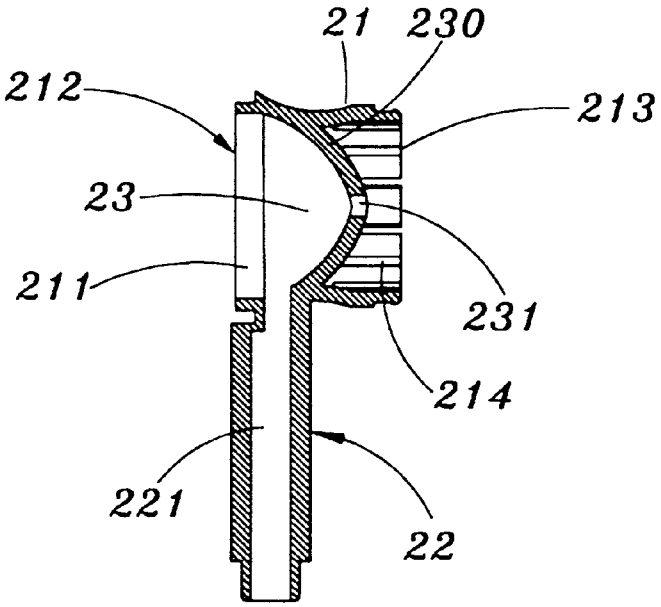
FIG. 4 is a sectional side view of the earphone housing of the earphone according to the above preferred embodiment of the present invention.

Referring to FIG. 4, the earphone housing 20 of this present invention includes a housing body 21 and a connecting hollow tube 22 integrally connected to the housing body 21 and extended downwardly from the housing body 21. The housing body 21 has a receiving chamber 211 therein, which has a first open-end 212 and a second open-end 213. The receiving chamber 211 is adapted for mounting the loudspeaker 10 therein. The earphone housing 20 has a sound inlet which includes a plurality of sound slots 214 provided around the second open-end 213 of the housing body 21. The connecting hollow tube 22 has a through hole 221 extended therethrough to communicate with the inside of the housing body 21, so as to enable a wire W passing through the through hole 221 of the connecting hollow tube 22 to extend into the housing body 21 for electrically connecting to the loudspeaker 10 mounted in the receiving chamber 211, as shown in FIG. 3.

Referring to FIGS. 3 and 6, the sound collecting hood 40, which covers the second open-end 213 of the earphone housing 20, is constructed to be adapted for firmly hanging between the tragus A1 and the antitragus A2 with stability, as shown in FIGS. 5 and 6.

Referring to FIGS. 1 to 4, according to the preferred embodiment of the present invention, the sound output hood 31 covers the first open-end 211 of the earphone housing 20, so as to enable a high intensive sound pressure generated by the first sound output end 11 of the loudspeaker 10 to be appropriately released to the outside environment through the meshes 31 provided on the sound output hood 30, wherein, the high intensive sound pressure will transmit around and return into the earphone housing 20 through the sound slots 214 provided around the second open-end 213 so as to interfere with the sound wave produced at the second sound output end 12 between the second sound output end 12 and the sound collecting hood 40 to form a combined sound wave by combining two sound waves with different phases together, which is then transmit to the human middle and inner ear through the meshes 41 provided on the sound collecting hood 40.

Referring to FIGS. 1 to 4, practically, waves produced at the first sound output end 11 and the second sound output end 12 of the loudspeaker 10 transmit to the sound output hood 30 and the sound collecting hood 40 respectively. At the mean time, high intensive sound pressure produced at the sound output end 11 will pass through the meshes 30 on the sound output hood 30 and spread outside. Therefore, most sound pressure will release to the air while part of the sound pressure produced at the sound output end 11 will return inside the housing body 21 through the sound slots 214 and interfere with the low intensive sound pressure wave produced at the back output end 12.

The high intensive sound wave and the low intensive sound wave with different phases meet and the Constructive and Destructive interference will occur. The frequency response will increase, that is the sum of the amplitudes, when the two sound waves are in phase (the difference of two phases is even integral multiple of 360 degree) due to the overlapping of wave peaks. Contrarily, the frequency response will decrease, that is the difference of the amplitudes, when the two sound waves are out of phase (the difference of two phases is odd integral multiple of 180 degree).

By means of the specifically designed earphone housing 20, the middle pitch of the sound frequency will be increased and the high and low pitch of the sound frequency will be decreased, so as to achieve a high quality sound interval which is a combination of waves without the high and low frequency of noise. This sound interval then transmits to the human ear for hearing through the meshes 41 provided on sound collecting hood 40.

Moreover, most of the sound pressure of the high intensive sound pressure produced at the front output end is released during the process of transmission. Therefore, although the high intensive wave are overlapped and interfered with the low intensive wave from the back output end 12, such process will only increase or decrease the frequency response and, practically, the combined sound interval is still in low intensive sound pressure stage. Accordingly, even though an audience continuously enjoys the impulsive music, his or her ears can enjoy the high quality sound without any unexpected injury caused by the sound pressure of the impulse noise.

Referring to FIGS. 3 to 4, the housing earphone 21 comprises a bowl shaped resonant wall 230 therein, which is integrally positioned between the first open-end 211 and the second open-end 213 so as to define a conical resonant chamber 23 between the loudspeaker 10 and the resonant wall 230. An open end of the resonant chamber 23 is communicated with the receiving chamber 211 of the earphone housing 20. The resonant wall 230 has at least one sound hole 231 provided at a bottom end thereof, wherein the sound wave produced at the back output end 12 of the loudspeaker 10 will be emitted through the sound hole 231. By adjusting the respective positions of the loudspeaker 10 and the sound hole 231 of the resonant wall 230, the sound waves with different displacements can thus be effectively controlled to process Constructive and Destructive interference between the back output end 12 and the sound collecting hood 40, so as to produce different resonant frequency response, so that the earphone of the present invention can be appropriately adjusted for different specification of earphone or communicator devices with the best sound interval output.

Figure 7:
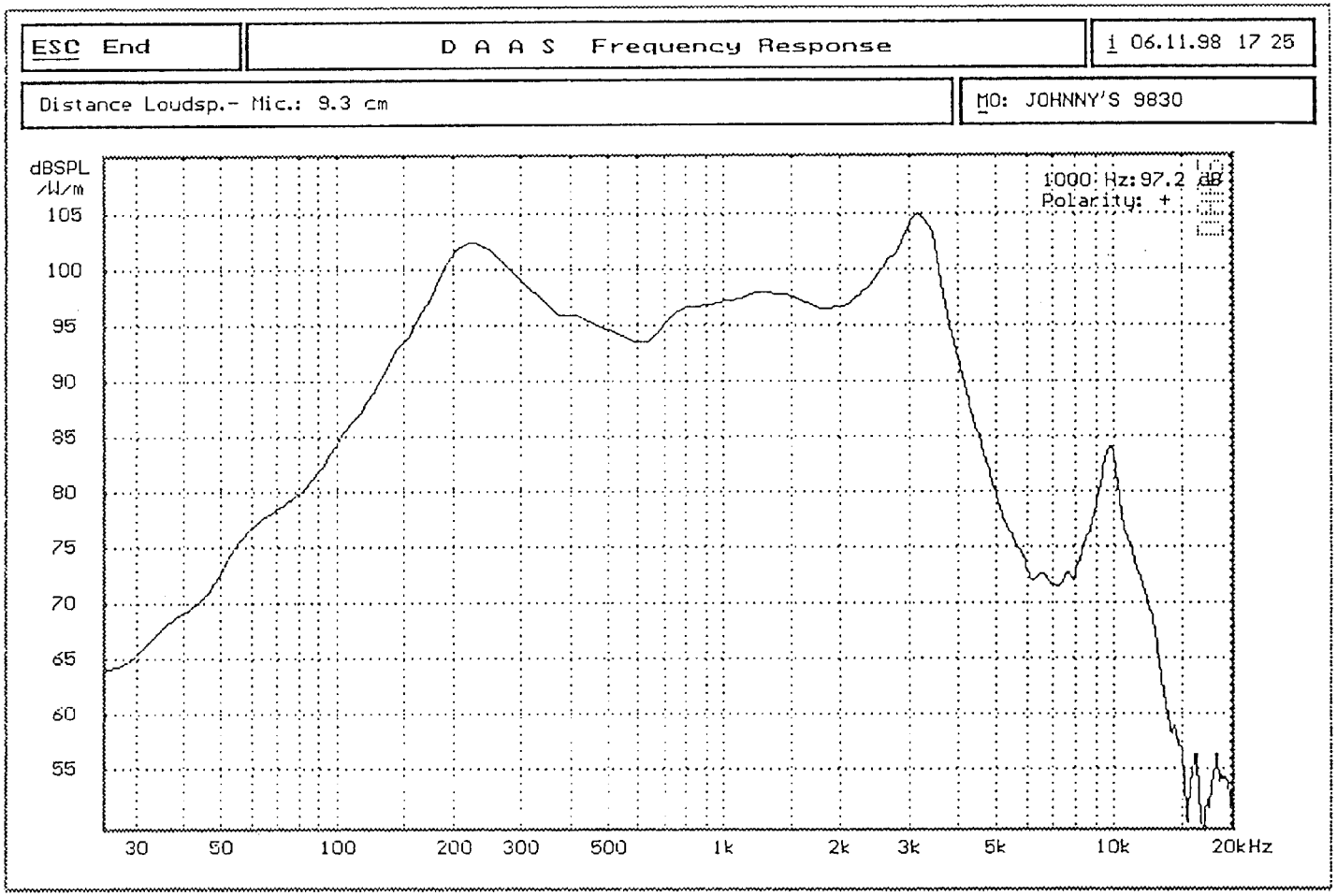
FIG. 7 is a diagram of analysis the frequency response by Digital Audio Analysis System.
Figure 8:
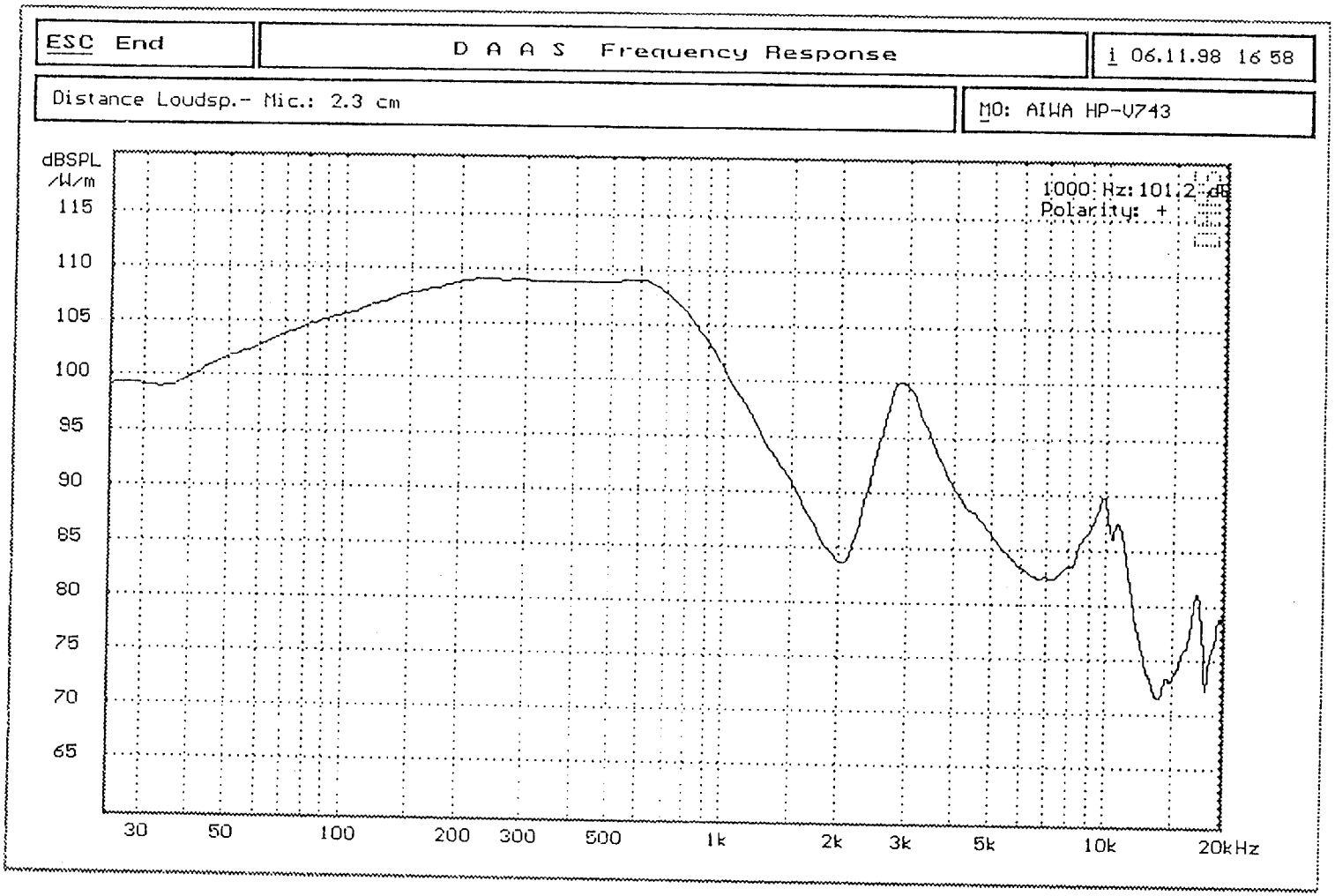
FIG. 8 is a diagram of comparison of the frequency response at same condition between AIWA present earphone (serial number: HP-V743) and this present invention.
Figure 9:
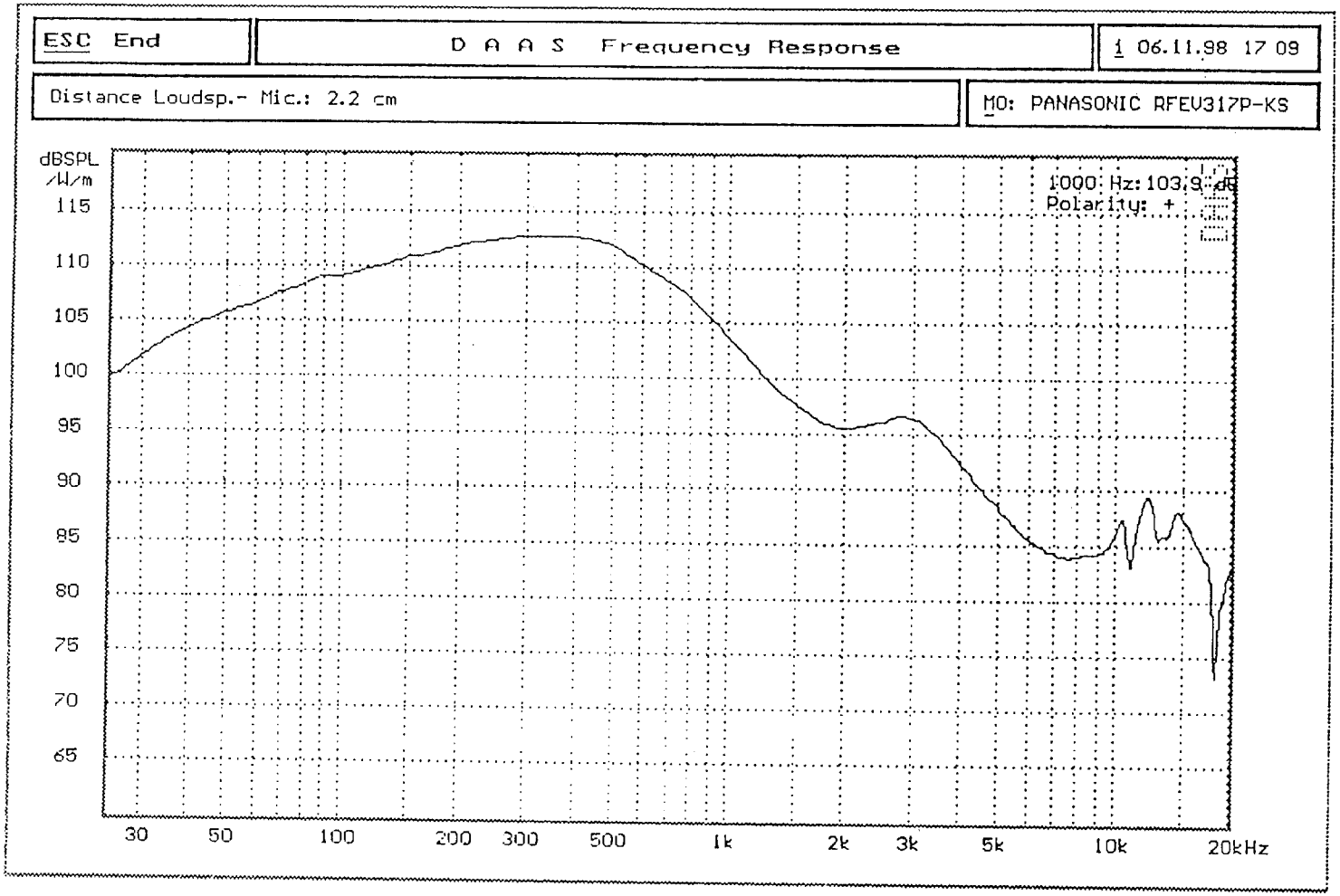
FIG. 9 is a diagram of comparison of the frequency response at same condition between PANASONIC present earphone (serial number: RFEV317P-KS) and this present invention.
Figure 10:
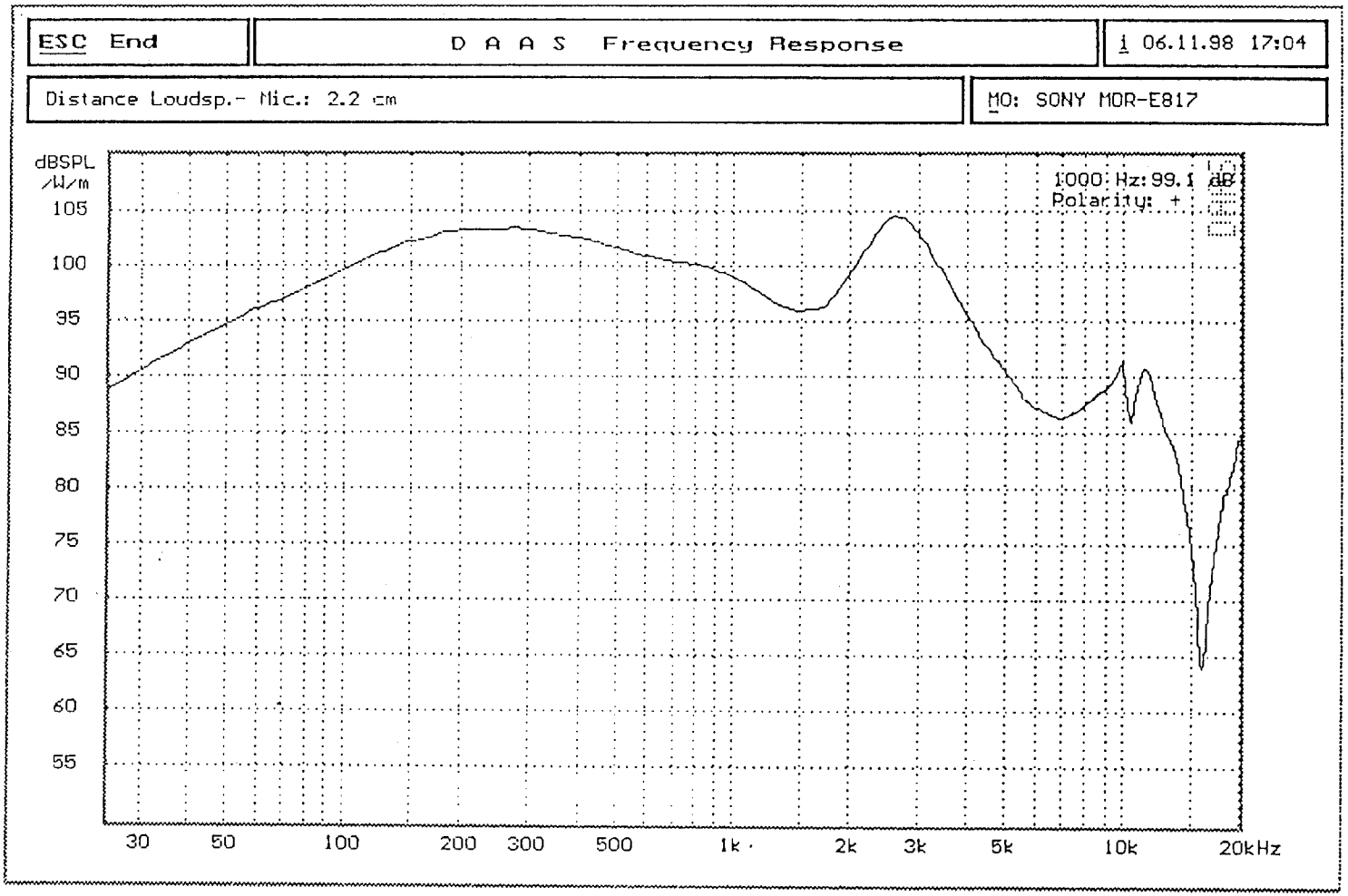
FIG. 10 is a diagram of comparison of the frequency response at same condition between SONY present earphone (serial number: MDR-E817) and this present invention.
Figure 11:
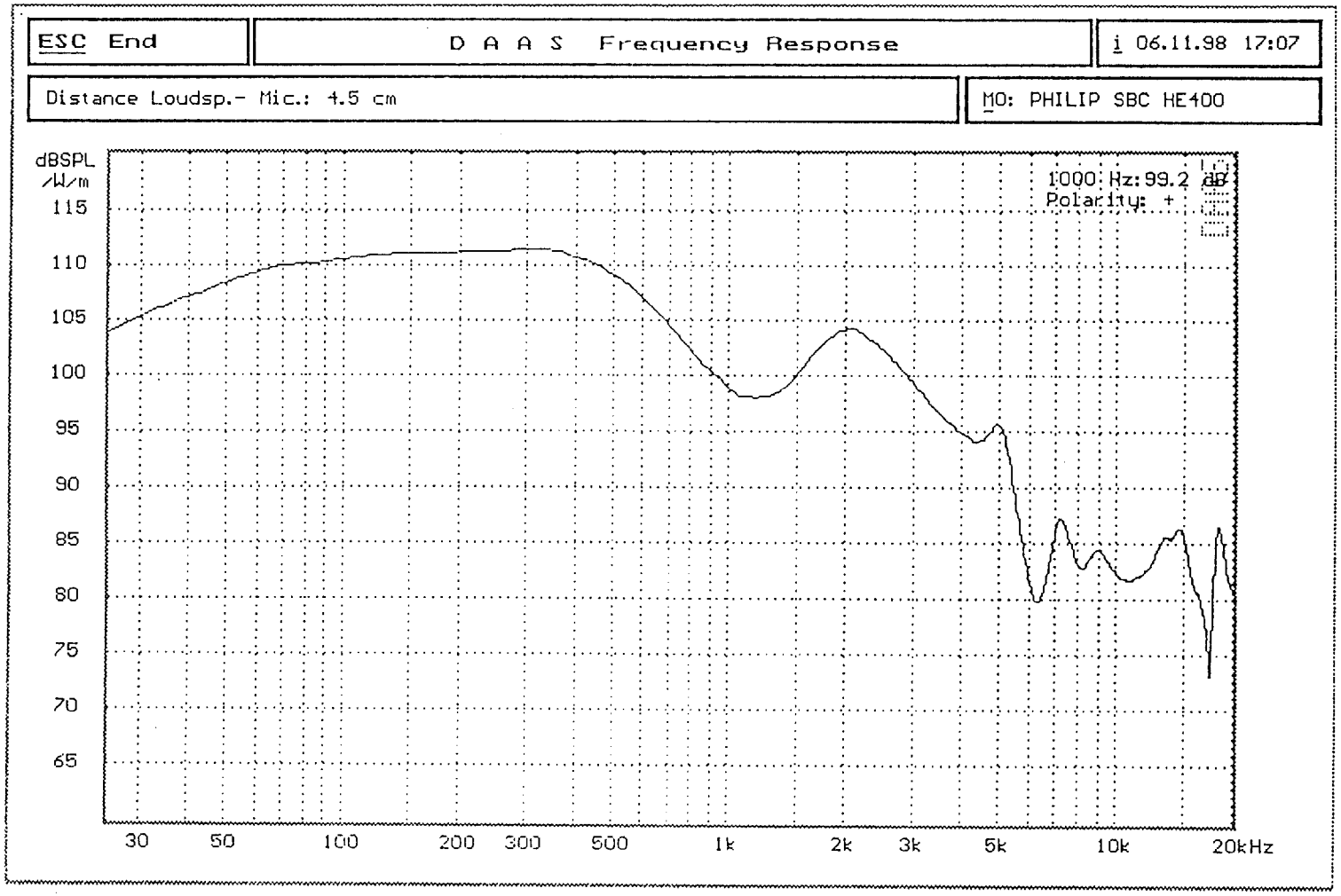
FIG. 11 is a diagram of comparison of the frequency response at same condition between PHILIPS present earphone (serial number: SBC-HE400) and this present invention.

Referring to FIGS. 7 to 10, in order to prove the effective of the present invention, the comparison of the well-known brand of existing earphone and the present invention with the same source of sound and test condition of DAAS (Digital Audio Analysis System) by the inventor, the results of the frequency response are as follow:

Referring to FIG. 7 of frequency response, the sound pressure of this present invention is obviously reduced at the high pitch area (10 kHz–20 kHz), the noise-attenuating and the best sound pressure output area is from 15 kHz to 20 kHz, the sound pressure is only 50 dB, contrarily, referring to FIG. 8 of frequency response, the lowest sound pressure is 72 dB at the high pitch area (10 kHz–20 kHz), the difference between the present invention is 22 dB; referring to FIG. 9 of frequency response, the lowest sound pressure is 75 dB at the high pitch area (10 kHz–20 kHz), the difference is 25 dB; referring to FIG. 10 of frequency response, the lowest sound pressure is 65 dB at the high pitch area (10 kHz–20 kHz), the difference between the present invention is 15 dB; referring to FIG. 11 of frequency response, the lowest sound pressure is 73 dB at the high pitch area (10 kHz–20 kHz), the difference between the present invention is 23 dB; these above compared values are the high pitch area, the compared values at the low pitch area (30 kHz–200 kHz) are as follow:

Referring to FIG. 7 of frequency response, the sound pressure of this present invention is 65 dB at 30 Hz; contrarily, referring to FIG. 8 of frequency response, the sound pressure is 99 dB at 30 Hz, the difference between the present invention is 34 dB; referring to FIG. 9 of frequency response, the sound pressure is 102 dB at 30 Hz, the difference between the present invention is 37 dB; referring to FIG. 10 of frequency response, the sound pressure is 90 dB at 30 Hz, the difference between the present invention is 25 dB; referring to FIG. 11 of frequency response, the sound pressure is 103 dB at 30 Hz, the difference between the present invention is 38 dB;

Comparing the difference of sound pressure values above, the present invention will not only generate the non-impulse noise of sound but also reduce the noise at high and low frequency ranges. Therefore, a conductive hearing loss will not happen to the people loving to use earphone for a long period.

What is claimed is:

1. An earphone without impulse noise and conductive hearing, comprising:

a loudspeaker having a first sound output end for producing a high intensive sound wave with high intensive sound pressure, and a second sound output end for producing a low intensive sound wave with low intensive sound pressure; and an earphone housing, which comprises:

a housing body having a first open-end, a second open-end and a receiving chamber therein for mounting said loudspeaker in such manner that said first sound output end and said second sound output end are facing to a said first open-end and said second open-end of said housing body;

a sound output hood, which has a plurality of meshes thereon and is provided at said first open-end of said housing body, being positioned in front of said first sound output end of said loudspeaker; and a sound collecting hood, which has a plurality of meshes thereon and is provided at said second open-end of said housing body, being positioned in front of said second sound output end of said loudspeaker; wherein said high intensive sound wave produced at said first sound output end emits outside said housing body through said meshes of said sound output hood and returns between said second sound output end of said loudspeaker and said sound collecting hood inside said housing body through a sound inlet provided around said housing body, wherein said sound output hood and said sound collecting hood cover said first open-end and said second open-end of said housing body respectively, wherein said sound collecting hood of said earphone housing is constructed as an earplug adapted for hanging between a tragus and an antitragus of a users ear;

thereby said high intensive sound wave and said low intensive sound wave are constructively and destructively interfered between said sound collecting hood and said second sound output end of said loudspeaker to form a combined sound wave with high-clarity sound interval to emit through said meshes of said sound collecting hood.

2. The earphone as recited in claim 1 wherein said earphone housing further includes a connecting hollow tube integrally connected to said housing body and extended downwardly from said housing body, wherein said connecting hollow tube has a through hole extended therethrough to communicate with said receiving chamber of said housing body so as to enable a wire passing through said through hole of said connecting hollow tube to extend into said housing body for electrically connecting to said loudspeaker mounted in said receiving chamber.

3. The earphone as recited in claim 2 wherein said sound inlet comprises a plurality of sound slots provided around said second open-end of said housing body.

4. The earphone as recited in claim 3 wherein said housing earphone further comprises a bowl shaped resonant wall therein, which is integrally positioned between said first open-end and said second open-end so as to define a conical resonant chamber between said loudspeaker and said resonant wall, wherein an open end of said resonant chamber is communicated with said receiving chamber of said earphone housing, and said resonant wall has at least one sound hole provided at a bottom end thereof.

5. The earphone as recited in claim 2 wherein said housing earphone further comprises a bowl shaped resonant wall therein, which is integrally positioned between said first open-end and said second open-end so as to define a conical resonant chamber between said loudspeaker and said resonant wall, wherein an open end of said resonant chamber is communicated with said receiving chamber of said earphone housing, and said resonant wall has at least one sound hole provided at a bottom end thereof.

6. The earphone as recited in claim 1 wherein said sound inlet comprises a plurality of sound slots provided around said second open-end of said housing body.

7. The earphone as recited in claim 6 wherein said housing earphone further comprises a bowl shaped resonant wall therein, which is integrally positioned between said first open-end and said second open-end so as to define a conical resonant chamber between said loudspeaker and said resonant wall, wherein an open end of said resonant chamber is communicated with said receiving chamber of said earphone housing, and said resonant wall has at least one sound hole provided at a bottom end thereof.

8. The earphone as recited in claim 1 wherein said housing earphone further comprises a bowl shaped resonant wall therein, which is integrally positioned between said first open-end and said second open-end so as to define a conical resonant chamber between said loudspeaker and said resonant wall, wherein an open end of said resonant chamber is communicated with said receiving chamber of said earphone housing, and said resonant wall has at least one sound hole provided at a bottom end thereof.

* * * * *